US008435932B2

(12) United States Patent
Baker et al.

(10) Patent No.: US 8,435,932 B2
(45) Date of Patent: May 7, 2013

(54) METHOD OF LUBRICATING AND LUBRICATING COMPOSITIONS THEREOF

(75) Inventors: Mark R. Baker, Lyndhurst, OH (US); Shreyasi Lahiri, Mentor, OH (US); Gabriel B. Rhoads, Derby (GB)

(73) Assignee: The Lubrizol Corporation, Wichliffe, OH (US)

( * ) Notice: Subject to any disclaimer, the term of this patent is extended or adjusted under 35 U.S.C. 154(b) by 551 days.

(21) Appl. No.: 12/374,382

(22) PCT Filed: Jul. 25, 2007

(86) PCT No.: PCT/US2007/074310

§ 371 (c)(1), (2), (4) Date: Sep. 21, 2009

(87) PCT Pub. No.: WO2008/014315

PCT Pub. Date: Jan. 31, 2008

(65) Prior Publication Data

US 2010/0016189 A1 Jan. 21, 2010

Related U.S. Application Data

(60) Provisional application No. 60/820,525, filed on Jul. 27, 2006.

(51) Int. Cl.
*C10M 135/36* (2006.01)
*C10M 135/22* (2006.01)

(52) U.S. Cl.
USPC ..... 508/273; 508/569

(58) Field of Classification Search ..... 508/273, 508/569
See application file for complete search history.

(56) References Cited

U.S. PATENT DOCUMENTS

| | | | | |
|---|---|---|---|---|
| 4,136,043 | A * | 1/1979 | Davis | 508/231 |
| 4,618,438 | A | 10/1986 | Toukan et al. | |
| 5,186,850 | A | 2/1993 | Okorodudu et al. | |
| 5,571,445 | A | 11/1996 | Srinivasan et al. | |
| 5,597,785 | A | 1/1997 | Karol | |
| 6,251,840 | B1 | 6/2001 | Ward, Jr. et al. | |
| 6,528,458 | B1 * | 3/2003 | Tagliamonte et al. | 508/185 |
| 6,689,723 | B2 | 2/2004 | Sullivan et al. | |
| 2003/0171222 | A1 * | 9/2003 | Sullivan et al. | 508/192 |
| 2004/0214729 | A1 | 10/2004 | Buitrago | |
| 2005/0041395 | A1 * | 2/2005 | Tipton et al. | 361/715 |

FOREIGN PATENT DOCUMENTS

| | | |
|---|---|---|
| EP | 1308496 | 5/2003 |
| EP | 1471134 | 10/2004 |

OTHER PUBLICATIONS

Search Report from corresponding PCT Publication No. WO 2008/014315 A3 dated Apr. 17, 2008.

Written Opinion from corresponding PCT international application No. PCT/US2007/074310 dated Feb. 19, 2008.

* cited by examiner

*Primary Examiner* — James Goloboy

(74) *Attorney, Agent, or Firm* — Michael F. Esposito; David M. Shold

(57) ABSTRACT

The present invention relates to a method of lubricating a mechanical device by using a lubricating composition containing a thiadiazole-functionalised dispersant. The invention further provides a lubricating composition suitable for the mechanical device containing a thiadiazole-functionalised dispersant and a polysulphide.

18 Claims, No Drawings

METHOD OF LUBRICATING AND LUBRICATING COMPOSITIONS THEREOF

FIELD OF INVENTION

The present invention relates to a method of lubricating a mechanical device by using a lubricating composition containing a thiadiazole-functionalised dispersant. The invention further provides a lubricating composition suitable for the mechanical device containing a thiadiazole-functionalised dispersant and a polysulphide.

BACKGROUND OF THE INVENTION

Driveline power transmitting devices such as gears or transmissions, especially axle fluids and manual transmission fluids (MTFs), present highly challenging technological problems and solutions for satisfying the multiple and often conflicting lubricating requirements, whilst providing durability and fuel economy. One of the important parameters influencing performance is lubricant viscosity. It is known that lubricants capable of performing at lower viscosity typically provide increased fuel economy. Conversely, lower viscosity fluids also contribute to elevated gear and transmission operating temperatures, especially for higher torque applications. Additionally, increasing lubricant viscosity is believed to provide better wear protection and durability to gears and transmissions. Consequently, it would be desirable to provide a correctly balanced lubricant composition to meet the needs of gears and transmissions.

U.S. Pat. No. 6,251,840 discloses a lubrication fluid for reduced air entrainment and improved gear protection. The lubrication fluid contains 0.025 wt % to 5 wt % of a 2,5-dimercapto-1,3,4-thiadiazole derivative. In one embodiment the 2,5-dimercapto-1,3,4-thiadiazole derivative discloses a DMTD/succinimide. The DMTD/succinimide may be prepared by the procedure of U.S. Pat. No. 4,136,043.

U.S. Pat. No. 4,136,043 discloses DMTD/succinimide dispersants and their methods of preparation. The dispersants formed contain 0.1-10 parts by weight of succinimide per part of DMTD. In the example section all of the DMTD/succinimide dispersants are prepared from succinic anhydride using chlorine.

EP 1 308 496 A2 discloses lubricating oils containing hydrocarbyl esters of a phosphorous acid and compounds with a 5-membered ring and at least two double bonded nitrogen atoms.

SUMMARY OF THE INVENTION

In one embodiment the invention provides a lubricating composition comprising an oil of lubricating viscosity, a thiadiazole-functionalised dispersant and a polysulphide, wherein the polysulphide comprises at least about 20 wt %, or at least about 30 wt % of tri- or higher sulphides.

In one embodiment the lubricating invention provide a lubricating composition comprising an oil lubricating viscosity and a thiadiazole-functionalised dispersant, wherein the dispersant contains ester-functional groups.

In one embodiment the invention provides a method of lubricating a driveline device comprising supplying to the device a lubricating composition comprising an oil of lubricating viscosity, a thiadiazole-functionalised dispersant and a polysulphide, wherein the polysulphide comprises at least about 20 wt %, or at least about 30 wt % of tri- or higher sulphides.

In one embodiment the invention provides a method of lubricating a driveline device comprising supplying to the device a lubricating composition comprising an oil of lubricating viscosity, and a thiadiazole-functionalised dispersant, wherein the dispersant comprises either (i) an ester dispersant or (ii) a succinimide dispersant, with the proviso that when the dispersant is a succinimide, about 0 mol % to less than about 50 mol % of the succinimide dispersant molecules contain a carbocyclic ring.

In one embodiment the invention provides for the use of the lubricating composition disclosed herein in gears and transmissions to impart at least one of acceptable fuel economy, acceptable lowering of operating temperatures, acceptable viscosity and acceptable wear protection.

In one embodiment the driveline device comprises at least one of a manual transmission or an axle gear.

DETAILED DESCRIPTION OF THE INVENTION

The present invention provides a lubricating composition and a method for lubricating a driveline device as disclosed above.

Unless otherwise stated, the wt % ranges quoted for the polysulphides, the thiadiazole-functionalised dispersant, and the other performance additives are quoted on an actives basis i.e., the ranges exclude the amounts of diluent oil that is commonly used as a carrier medium for the additives. Diluent oil is commonly present in the various additives at different amounts in ranges including 0 wt % to 60 wt % as is available commercially.

Polysulphides

The invention comprises a polysulphide that is known in the art. As used herein the term "polysulphide" includes compounds that contain three or more sulphur atoms including oligomeric species that may have multiple mono- or di-sulphide linkages within the same molecule.

The polysulphide are generally characterized as having sulphur-sulphur linkages. Typically the linkages have about 2 to about 8 sulphur atoms, or about 2 to about 6 sulphur atoms, or 2 to about 4 sulphur atoms.

In one embodiment the polysulphide contains at least about 20 wt %, or at least about 30 wt % of the polysulphide molecules contain three or more sulphur atoms.

In one embodiment at least about 50 wt % of the polysulphide molecules are a mixture of tri- or tetra-sulphides. In other embodiments at least about 55 wt %, or at least about 60 wt % of the polysulphide molecules are a mixture of tri- or tetra-sulphides.

In one embodiment up to about 90 wt % of the polysulphide molecules are a mixture of tri- or tetra-sulphides. In other embodiments up to about 80 wt % of the polysulphide molecules are a mixture of tri- or tetra-sulphides.

The polysulphide in other embodiments contain about 0 wt % to about 20 wt %, or about 0.1 to about 10 wt % of a penta- or higher polysulphide.

In one embodiment the polysulphide contains less than about 30 wt % or less than about 40 wt % of a disulphide in the polysulphide.

The polysulphide typically provides about 0.5 to about 5 wt %, or about 1 to about 3 wt % of sulphur to the lubricating composition.

The polysulphide includes a sulphurised organic polysulphide including oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain about 8 to about 30, or about 12 to about 24 carbon atoms. Examples of fatty acids include oleic, linoleic, linolenic, tall oil and rosin acids. Sulfurized fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain about 3 to about 30 carbon atoms. In other embodiments, olefins contain about 3 to about 16, or about 3 to about 9 carbon atoms. In one embodiment the sulphurised olefin includes an olefin derived from propylene, isobutylene, pentene or mixtures thereof.

In one embodiment the polysulphide comprises a polyolefin derived from polymerising by known techniques an olefin as described above.

In one embodiment the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts; phosphosulphurised hydrocarbons.

In different embodiments the polysulphide is present in the lubricating composition in ranges including about 0.01 to about 10 wt %, or about 0.1 wt % to about 8 wt %, or about 0.25 wt % to about 6 wt % of the lubricating composition.

Thiadiazole-Functionalised Dispersant

The invention comprises a thiadiazole-functionalised dispersant that is prepared by a method including heating, reacting or complexing a thiadiazole compound with a dispersant substrate. The thiadiazole compound may be covalently bonded, salted, complexed or otherwise solubilised with a dispersant.

The relative amounts of the dispersant substrate and the thiadiazole used to prepare the thiadiazole-functionalised dispersant may vary. In one embodiment the dispersant substrate is present at about 0.1 to about 10 parts by weight relative to about 1 part by weight of the thiadiazole compound. In different embodiments the dispersant substrate is present at greater than about 0.1 to about 9, or greater than about 0.1 to less than about 5, or about 0.2 to less than about 5: to about 1 part by weight of the thiadiazole compound. The relative amounts of the dispersant substrate to the thiadiazole compound may also be expressed as 0.1-10:1, or >0.1-9:1, or >0.5-9:1, or 0.1 to less than 5:1, or 0.2 to less than 5:1.

The thiadiazole-functionalised dispersant is present in the lubricating composition in ranges including about 0.1 wt % to about 8 wt %, or about 0.3 wt % to about 4 wt %, or about 0.35 wt % to about 2 wt % of the lubricating composition.

Thiadiazole Compound

Examples of a thiadiazole include 2,5-dimercapto-1,3-4-thiadiazole, 2,5-dimercapto-1,3,4-thiadiazole, or oligomers thereof, a hydrocarbyl-substituted 2,5-dimercapto-1,3-4-thiadiazole, a hydrocarbylthio-substituted 2,5-dimercapto-1,3-4-thiadiazole, or oligomers thereof. The oligomers of hydrocarbyl-substituted 2,5-dimercapto-1,3-4-thiadiazole typically form by forming a sulphur-sulphur bond between 2,5-dimercapto-1,3-4-thiadiazole units to form oligomers of two or more of said thiadiazole units.

In different embodiments the number of carbon atoms on the hydrocarbyl substituents includes ranges of about 1 to about 30, about 2 to about 20 or about 3 to about 16. In one embodiment the thiadiazole compound, e.g., hydrocarbyl-substituted mercaptothiadizoles (as well as the unsubstituted materials), is typically substantially soluble at about 25° C. in non-polar media such as an oil of lubricating viscosity. Thus, the total number of carbon atoms in the hydrocarbyl-substituents, which tend to promote solubility, will generally be about 8 or more, or about 10 or more, or at least about 12. If there are multiple hydrocarbyl substituents, typically each substituent will contain about 8 or fewer carbon atoms. In one embodiment the thiadiazole compound, e.g. hydrocarbyl-substituted mercaptothiadazoles (as well as the unsubstituted materials), is typically substantially insoluble at about 25° C. in non-polar media such as an oil of lubricating viscosity. Thus, the total number of carbon atoms in the hydrocarbyl-substituents, which tend to promote solubility, will generally be fewer than about 8, or about 6, or about 4. If there are multiple hydrocarbyl substituents, typically each substituent will contain about 4 or fewer carbon atoms.

By the term "substantially insoluble" it is meant that the thiadiazole compound e.g., a dimercaptothiadiazole (DMTD) compound, may typically dissolve to an extent of less than about 0.1 weight percent, or less than 0.01 or about 0.005 weight percent in oil at room temperature (about 25° C.). A suitable hydrocarbon oil of lubricating viscosity in which the solubility may be evaluated is Chevron™ RLOP 100 N oil. The specified amount of the DMTD or substituted DMTD is mixed with the oil and the solubility may be evaluated by observing clarity versus the appearance of residual sediment after, e.g., 1 week of storage.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadaizole. Typically readily available materials such as 2,5-dimercapto-1,3,4-thiadiazole or a hydrocarbyl-substituted 2,5-dimercapto-1,3-4-thiadiazole or a hydrocarbylthio-substituted 2,5-dimercapto-1,3,4-thiadiazole are commonly utilised, with 2,5-dimercapto-[1,3,4]-thiadiazole most commonly utilised due to availability. In several embodiments the number of carbon atoms on the hydrocarbyl-substituent group includes about 1 to about 30, about 2 to about 25, about 4 to about 20, about 6 to about 16, or about 8 to about 10.

In one embodiment, the thiadiazole compound is the reaction product of a phenol with an aldehyde and a dimercaptothiadiazole. The phenol includes an alkyl phenol wherein the alkyl group contains at least about 6, e.g., about 6 to 24, or about 6 (or about 7) to about 12 carbon atoms. The aldehyde includes an aldehyde containing about 1 to about 7 carbon atoms or an aldehyde synthon, such as formaldehyde. In one embodiment, the aldehyde is formaldehyde or paraformaldehyde. The aldehyde, phenol and dimercaptothiadiazole are typically reacted by mixing them at a temperature up to about 150° C. such as about 50° C. to about 130° C., in molar ratios of about 0.5 to about 2 moles of phenol and about 0.5 to about 2 moles of aldehyde per mole of dimercaptothiadiazole. In one embodiment, the three reagents are reacted in equal molar amounts. The product may be described as an alkylhydroxyphenylmethylthio-substituted [1,3,4]-thiadiazole; the alkyl moiety includes, hexyl, heptyl, octyl, or nonyl.

Useful thiadiazole compounds include 2-alkyldithio-5-mercapto-[1,3,4]-thiadiazoles, 2,5-bis(alkyldithio)-[1,3,4]-thiadiazoles, 2-alkyl-hydroxyphenylmethylthio-5-mercapto-[1,3,4]-thiadiazoles, and mixtures thereof.

Examples of suitable thiadiazole compounds include 2-octyldithio-5-mercapto-1,3,4-thiadiazole, 2-nonyldithio-5-mercapto-1,3,4-thiadiazole, 2-dodecydithio-5-mercapto-1,3,4-thiadiazole, or 2,5-dimercapto-1,3,4-thiadiazole. Examples of suitable 2,5-bis(alkyl-dithio)-1,3,4-thiadiazoles) include 2,5-bis(tert-octyldithio)-1,3,4-thiadiazole, 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyldithio)-1,3,4-thiadiazole, 2,5-bis(tert-hexadecyldithio)-1,3,4-thiadiazole, 2,5-bis(tert-heptadecyldithio)-1,3,4-thiadiazole, 2,5-bis(tert-octadecyldithio)-1,3,4-thiadiazole, 2,5-bis(tert-nonadecyldithio)-1,3,4-thiadiazole or 2,5-bis(tert-eicosyldithio)-1,3,4-thiadiazole, or oligomers thereof. In one embodiment the hydrocarbyl-substituted 2,5-dimercapto-1,3-4-thiadiazole comprises at least one of 2,5-bis(tert-octyldithio)-1,3,4-thiadiazole 2,5-bis(tert-nonyldithio)-1,3,4-thiadiazole, or 2,5-bis(tert-decyldithio)-1,3,4-thiadiazole.

In one embodiment the thiadiazole compound includes at least one of 2,5-bis(tert-octyldithio)-1,3,4-thiadiazole, 2,5-bis(tert-nonyldithio)-1,3,4-thiadiazole, or 2,5-bis(tert-decyldithio)-1,3,4-thiadiazole.

Dispersant Substrate

The dispersant substrate includes a succinimide dispersant (for example, N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant, a polyetheramine dispersant, a viscosity modifier containing dispersant functionality (for example polymeric viscosity index modifiers (VMs) containing dispersant functionality), or mixtures thereof. In one embodiment the dispersant substrate includes a succinimide dispersant, an ester-containing dispersant or a Mannich dispersant.

In one embodiment the thiadiazole-functionalised dispersant is prepared by heating together ingredients comprising:

(i) a dispersant substrate;
(ii) a thiadiazole compound;
(iii) optionally a borating agent; and
(iv) optionally a dicarboxylic acid of an aromatic compound selected from the group consisting of 1,3 diacids and 1,4 diacids, and
(v) optionally a phosphorus acid compound, said heating being sufficient to provide a product of (i), (ii), (iii) and optionally (iv) and optionally (v), which is soluble in an oil of lubricating viscosity.

The borating agent includes various forms of boric acid (including metaboric acid, $HBO_2$, orthoboric acid, $H_3BO_3$, and tetraboric acid, $H_2B_4O_7$), boric oxide, boron trioxide, and alkyl borates, such as those of the formula $(RO)_xB(OH)_y$, wherein x is about 1 to about 3 and y is about 0 to about 2, the sum of x and y being 3, and where R is an alkyl group containing about 1 to about 6 carbon atoms. In one embodiment, the boron compound is an alkali or mixed alkali metal and alkaline earth metal borate. These metal borates are generally hydrated particulate metal borates which are known in the art. In one embodiment the metal borates include mixed alkali and alkaline earth metal borates. The metal borates are available commercially.

The 1,3-dicarboxylic acid or 1,4-dicarboxylic acid is reacted or complexed with the thiadiazole-functionalised dispersant. The term "reactive equivalents thereof" includes acid halides, esters, amides or mixtures thereof. The "aromatic component" of the 1,3-dicarboxylic acid or 1,4-dicarboxylic acid is typically a benzene (phenylene) ring or a substituted benzene ring, although other aromatic materials such as fused ring compounds or heterocyclic compounds are also contemplated. It is believed (without intending to be bound by any theory) that the dicarboxylic acid aromatic compound may be bound to the thiadiazole-functionalised dispersant by salt formation or complexation, rather than formation of covalently bonded structures such as amides, which may also be formed but may play a less important role. Typically the presence of the dicarboxylic acid aromatic compound within the present invention is believed to impart corrosion inhibition properties to the composition. Examples of suitable dicarboxylic acids include 1,3-dicarboxylic acids such as isophthalic acid and alkyl homologues such as 2-methyl isophthalic acid, 4-methyl isophthalic acid or 5-methyl isophthalic acid; and 1,4-dicarboxylic acids such as terephthalic acid and alkyl homologues such as 2-methyl terephthalic acid. In other embodiments ring substituents such as hydroxy or alkoxy (e.g., methoxy) groups are present. In one embodiment the aromatic compound is terephthalic acid.

The phosphorus acid compound typically contains an oxygen atom and/or a sulfur atom as its constituent elements, and is typically a phosphorus acid or anhydride. This component includes phosphorous acid, phosphoric acid, hypophosphoric acid, polyphosphoric acid, phosphorus trioxide, phosphorus tetroxide, phosphorus pentoxide ($P_2O_5$), phosphorotetrathionic acid ($H_3PS_4$), phosphoromonothionic acid ($H_3PO_3S$), phosphorodithionic acid ($H_3PO_2S_2$), phosphorotrithionic acid ($H_3PO_2S_3$), and $P_2S_5$. Among these, phosphorous acid and phosphoric acid or their anhydrides are typically used. A salt, such as an amine salt of a phosphorus acid compound may also be used. It is also possible to use a plurality of these phosphorus acid compounds together. The phosphorus acid compound is often phosphoric acid or phosphorous acid or their anhydride.

In other embodiments the phosphorus acid compound includes phosphorus compounds with a phosphorus oxidation of +3 or +5, such as phosphates, phosphonates, phosphinates, or phosphine oxides. A more detailed description for these suitable phosphorus acid compounds is given in U.S. Pat. No. 6,103,673, column 9, line 64 to column 11, line 8.

In one embodiment the thiadiazole-functionalised dispersant is a succinimide prepared as described in Examples 26 to 35 of U.S. Pat. No. 4,136,043. The dispersants of the type disclosed in U.S. Pat. No. 4,136,043 may be derived from a polyisobutylene succinic anhydride prepared by a chlorine mediated process. Typically, a dispersant prepared from a chlorine mediated process have about 50 mole % to about 100 mole %, or about 60 to about 100 mole % of the dispersant molecules having a carbocyclic ring.

In one embodiment the thiadiazole-functionalised dispersant is a succinimide prepared as described in Examples 1-4 of International Patent Application PCT/US06/004576; or Examples 1-4 of International Publication WO2005/021692, both titled "Multifunctional Dispersants".

In one embodiment the thiadiazole-functionalised dispersant is a succinimide prepared as described in a co-pending patent application filed along with the present Application entitled "Multi-Dispersant Lubricating Composition," inventors of Tipton and Abraham). Specifically the thiadiazole-functionalised dispersant are prepared in Preparative Examples 1 to 3.

The thiadiazole-functionalised dispersant of International Patent Application PCT/US06/004576, International Publication WO2005/021692 and the co-pending patent application by Tipton and Abraham, typically describe dispersant that may be derived from a polyisobutylene succinic anhydride prepared by an "ene" reaction.

The "ene" reaction mechanism and general reaction conditions are summarised in "Maleic Anhydride", pages, 147-149, Edited by B. C. Trivedi and B. C. Culbertson and Published by Plenum Press in 1982.

When the dispersant substrate is prepared by an "ene" reaction, about 0 mole % to less than about 50 mole %, or about 0 to less than about 30 mole % of the dispersant molecules contain a carbocyclic ring.

In one embodiment the thiadiazole-functionalised dispersant is an ester-containing dispersant. The thiadiazole-functionalised dispersant it typically prepared by reacting a polyisobutylene succinic anhydride with a polyol or mixtures thereof. The polyol includes for example, pentaerythritol.

In one embodiment the thiadiazole-functionalised dispersant is prepared by reacting a polyisobutylene succinic anhydride with a mixture of a polyol and an amine. Examples of a suitable amine include polyamines such as diethylene triamine, triethylene tetramine, tetraethylene pentamine, pentaethylene hexamine or, in one embodiment, polyamine still bottoms.

Oils of Lubricating Viscosity

The lubricating oil composition includes natural or synthetic oils of lubricating viscosity, oil derived from hydrocracking, hydrogenation, hydrofinishing, and unrefined, refined and re-refined oils and mixtures thereof.

Natural oils include animal oils, vegetable oils, mineral oils and mixtures thereof. Synthetic oils include hydrocarbon oils, silicon-based oils, and liquid esters of phosphorus-containing acids. Synthetic oils may be produced by Fischer-Tropsch gas-to-liquid synthetic procedure as well as other gas-to-liquid oils. In one embodiment the composition of the present invention is useful when employed in a gas-to-liquid oil. Often Fischer-Tropsch hydrocarbons or waxes may be hydroisomerised.

In one embodiment the base oil comprises a polyalphaolefin (PAO) including a PAO-2, PAO-4, PAO-5, PAO-6, PAO-7 or PAO-8, where the convention—digit indicates the nominal kinematic viscosity at 100° C. in $mm^2/s$ (or cSt). The polyalphaolefin in one embodiment is prepared from dodecene and in another embodiment from decene.

In one embodiment the oil of lubricating viscosity is an ester such as an adipate.

In one embodiment the oil of lubricating viscosity includes a polymer (may also be referred to as a viscosity modifier) including hydrogenated copolymers of styrene-butadiene, ethylene-propylene polymers, polyisobutenes, hydrogenated styrene-isoprene polymers, hydrogenated isoprene polymers, polymethacrylate acid esters, polyacrylate acid esters, polyalkyl styrenes, alkenyl aryl conjugated diene copolymers, polyolefins, polyalkylmethacrylates and esters of maleic anhydride-styrene copolymers. In several embodiments the viscosity modifier includes polymethacrylate acid esters, polyacrylate acid esters, polyalkylmethacrylates and esters of maleic anhydride-styrene copolymers, polyisobutenes or mixtures thereof.

In several embodiments the oil of lubricating viscosity contains a polymer (or viscosity modifier) present in ranges including 0 wt % to 70 wt %, or about 5 wt % to 65 wt %, or about 10 to about 60 wt %, or about 15 to about 50 wt % of the lubricating composition. In one embodiment the lubricating composition comprises an oil of lubricating viscosity containing mixtures of a viscosity modifier and an API Group III or IV base oil. In one embodiment the lubricating composition contains a synthetic oil of lubricating viscosity.

Oils of lubricating viscosity may also be defined as specified in the American Petroleum Institute (API) Base Oil Interchangeability Guidelines. In one embodiment the oil of lubricating viscosity comprises an API Group I, II, III, IV, V, VI base oil, or mixtures thereof, and in another embodiment API Group II, III, IV base oil or mixtures thereof. In another embodiment the oil of lubricating viscosity is a Group III or IV base oil and in another embodiment a Group IV base oil.

The amount of the oil of lubricating viscosity present is typically the balance remaining after subtracting about 100 wt % the sum of the amount of the thiadiazole-functionalised dispersant, the polysulphide, and the other performance additives (described below).

In one embodiment the lubricating composition is in the form of a concentrate and/or a fully formulated lubricant. If the thiadiazole-functionalised dispersant, the polysulphide and the other performance additives are in the form of a concentrate (which may be combined with additional oil to form, in whole or in part, a finished lubricant), the ratio of the components of the lubricating composition to the oil of lubricating viscosity and/or to diluent oil include the ranges of about 1:99 to about 99:1 by weight, or about 80:20 to about 10:90 by weight.

Other Performance Additive

The composition optionally further includes at least one other performance additive. The other performance additives include antiwear agents, friction modifiers, metal deactivators, detergents, dispersants other than the dispersants described above, viscosity index improvers, antioxidants, corrosion inhibitors, foam inhibitors, demulsifiers, pour point depressants, seal swelling agents and mixtures thereof.

The total combined amount of the other performance additive compounds present on an oil free basis include ranges of about 0 wt % to about 25 wt %, or about 0.1 wt % to about 15 wt % or about 0.5 wt % to about 10 wt %, of the lubricating composition. In one embodiment one or more of the other performance additives are present. It is common for the other performance additives to be present in different amounts relative to each other.

Antiwear Agent

In one embodiment the lubricating composition further comprises an antiwear agent, typically containing phosphorus.

The antiwear agent present in the lubricating composition in ranges that include about 0 wt % to about 20 wt %, or about 0.05 wt % to about 10 wt %, or about 0.1 wt % to about 5 wt % of the lubricating composition.

The antiwear agent includes a phosphorus-containing acid, salt, polymer or ester. In one embodiment the antiwear is in the form of a mixture.

The antiwear agent includes ash-containing (i.e. metal containing) or ashless (i.e. metal free (prior to being mixed with other components)).

In one embodiment the antiwear agent comprises a phosphorus-containing acid, salt or ester.

The phosphorus-containing acid, salt or ester includes (i) a non-ionic phosphorus compound; (ii) an amine salt of a phosphorus compound; (iii) an ammonium salt of a phosphorus compound; (iv) a monovalent metal salt of a phosphorus compound, such as a metal dialkyldithiophosphate or a metal dialkylphosphate; or (v) mixtures of (i), (ii), (iii) or (iv).

In one embodiment the phosphorus-containing acid, salt or ester comprises a metal dialkyldithiophosphate. The alkyl groups of the dialkyldithiophosphate include linear or branched containing about 2 to about 20 carbon atoms, provided that the total number of carbons is sufficient to make the metal dialkyldithiophosphate oil soluble. The metal of the metal dialkyldithiophosphate typically includes monovalent or divalent metals. Examples of suitable metals include sodium, potassium, copper, calcium, magnesium, barium or zinc. In one embodiment the phosphorus-containing acid, salt or ester is a zinc dialkyldithiophosphate. Examples of a suitable zinc dialkylphosphate often referred to as ZDDP, ZDP or ZDTP) include zinc di-(2-methylpropyl)dithiophosphate, zinc di-(amyl)dithiophosphate, zinc di-(1,3dimethylbutyl) dithiophosphate, zinc di-(heptyl)dithiophosphate, zinc di-(octyl)dithiophosphate di-(2-ethylhexyl)dithiophosphate, zinc di-(nonyl)dithiophosphate, zinc di-(decyl)dithiophosphate, zinc di-(dodecyl)dithiophosphate, zinc di-(dodecylphenyl)dithiophosphate, zinc di-(heptylphenyl)dithiophosphate, or mixtures thereof.

In one embodiment the phosphorus-containing acid, salt or ester is other than metal dialkyldithiophosphate.

In one embodiment the phosphorus-containing acid, salt or ester comprises an ammonium or amine salt of a phosphorus-containing acid or ester.

The amine salt of a phosphorus acid or ester includes phosphoric acid esters and amine salts thereof; dialkyldithiophosphoric acid esters and amine salts thereof; amine salts of phosphites; and amine salts of phosphorus-containing carboxylic esters, ethers, and amides; and mixtures thereof.

The amine salt of a phosphorus acid or ester may be used alone or in combination. In one embodiment the amine salt of a phosphorus compound is derived from an amine salt of a phosphorus compound, or mixtures thereof.

In one embodiment the amine salt of a phosphorus acid or ester includes a partial amine salt-partial metal salt compounds or mixtures thereof. In one embodiment the amine salt of a phosphorus acid or ester further comprises a sulphur atom in the molecule.

Amines that are suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups contain carbon atoms present in ranges that include about 2 to about 30, or about 8 to about 26, or about 10 to about 20, or about 13 to about 19.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines include cyclic amines such as piperidine, piperazine and morpholine.

In one embodiment the amine is a tertiary-aliphatic primary amine. The aliphatic group includes an alkyl group containing about 2 to about 30, or about 6 to about 26, or about 8 to about 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the amine salt of a phosphorus acid or ester includes an amine with C11 to C14 tertiary alkyl primary groups or mixtures thereof. In one embodiment the amine salt of a phosphorus compound includes an amine with C14 to C18 tertiary alkyl primary amines or mixtures thereof. In one embodiment the amine salt of a phosphorus compound includes an amine with C18 to C22 tertiary alkyl primary amines or mixtures thereof.

Mixtures of amines may also be used in the invention. In one embodiment a useful mixture of amines is "Primene® 81R" or "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment the amine salt of a phosphorus acid or ester is the reaction product of a C14 to C18 alkylated phosphoric acid with Primene 81R™ (produced and sold by Rohm & Haas) which is a mixture of C11 to C14 tertiary alkyl primary amines.

Examples of the amine salt of a phosphorus acid or ester include the reaction product(s) of isopropyl, methyl-amyl (1,3-dimethylbutyl) or mixtures thereof, 2-ethylhexyl, heptyl, octyl or nonyl dithiophosphoric acids with ethylene diamine, morpholine, or Primene 81R™, and mixtures thereof.

In one embodiment a dithiophosphoric acid is reacted with an epoxide or a glycol. This reaction product is further reacted with a phosphorus acid, anhydride, or lower ester (where "lower" signifies about 1 to about 8, or about 1 to about 6, or about 1 to about 4, or 1 to about 2 carbon atoms in the alcohol-derived portion of the ester). The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is propylene oxide. The glycols include aliphatic glycols having 1 to about 12, or about 2 to about 6, or about 2 to about 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at about 58° C. over a period of about 45 minutes to about 514 grams of hydroxypropyl O,O-di(4-methyl-2-pentyl)phosphorodithioate (prepared by reacting di(1,3-dimethylbutyl)-phosphorodithioic acid with about 1.3 moles of propylene oxide at about 25° C.). The mixture is heated at about 75° C. for about 2.5 hours, mixed with a diatomaceous earth and filtered at about 70° C. The filtrate contains about 11.8% by weight phosphorus, about 15.2% by weight sulphur, and an acid number of 87 (bromophenol blue).

In one embodiment the phosphorus-containing acid, salt or ester comprises a non-ionic phosphorus compound. Typically the non-ionic phosphorus compound have an oxidation of +3 or +5. The different embodiments comprise phosphite ester, phosphate esters, or mixtures thereof. A more detailed description of the non-ionic phosphorus compound include column 9, line 48 to column 11, line 8 of U.S. Pat. No. 6,103,673.

Antioxidants include molybdenum compounds such as molybdenum dithiocarbamates, sulphurised olefins, hindered phenols, aminic compounds (such as alkylated diphenylamines (typically di-nonyl diphenylamine, octyl diphenylamine, di-octyl diphenylamine)); detergents include neutral or overbased detergents, Newtonian or non-Newtonian, basic salts of alkali, alkaline earth or transition metals with one or more of a phenate, a sulphurised phenate, a sulphonate, a carboxylic acid, a phosphorus acid, a mono- and/or a dithiophosphoric acid, a saligenin, an alkylsalicylate, and a salixarate; and dispersants include N-substituted long chain alkenyl succinimides, as well as Mannich condensation products as well as post-treated versions thereof. Post-treated dispersants include those by reaction with urea, thiourea, dimercaptothiadiazoles, carbon disulphide, aldehydes, ketones, carboxylic acids, hydrocarbon-substituted succinic anhydrides, nitriles, epoxides, boron compounds, and phosphorus compounds.

Friction modifiers include fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, condensation products of fatty acids with guanidine, aminoguanidine, urea, thiourea or derivatives thereof, condensation products of carboxylic acids and polyalkylene-polyamines.

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylate acid esters, polyacrylate acid esters, polyalkyl styrenes, alkenyl aryl conjugated diene copolymers, polyolefins, polyalkylmethacrylates and esters of maleic anhydride-styrene copolymers.

Other performance additives such as corrosion inhibitors include octylamine octanoate, condensation products of dodecenyl succinic acid or anhydride and a fatty acid such as oleic acid with a polyamine; metal deactivators include derivatives of benzotriazoles (typically tolyltriazole), 1,2,4-triazoles, benzimidazoles, 2-alkyldithiobenzimidazoles, thiadiazole compounds (such as those listed above) or 2-alkyldithiobenzothiazoles; foam inhibitors include copolymers of ethyl acrylate and 2-ethylhexylacrylate and optionally vinyl acetate; demulsifiers include trialkyl phosphates, polyethylene glycols, polyethylene oxides, polypropylene oxides and (ethylene oxide-propylene oxide) polymers; pour point depressants include esters of maleic anhydride-styrene, polymethacrylates, polyacrylates or polyacrylamides; and seal swell agents include Exxon Necton-37™ (FN 1380) and Exxon Mineral Seal Oil (FN 3200); and dispersant viscosity modifiers (often referred to as DVM) include functionalised polyolefins, for example, ethylene-propylene copolymers that have been functionalized with the reaction product of maleic anhydride and an amine, a polymethacrylate functionalised with an amine, or styrene-maleic anhydride copolymers reacted with an amine; may also be used in the composition of the invention.

INDUSTRIAL APPLICATION

The method is useful for lubricating a variety of driveline devices. The driveline device comprises at least one of a gear, a gearbox, an axle gear, a traction drive transmission, an automatic transmission or a manual transmission. In one embodiment the mechanical device is a manual transmission or a gear, a gearbox, an axle gear.

The automatic transmission includes continuously variable transmissions (CVT), infinitely variable transmissions (IVT), Torroidal transmissions, continuously slipping torque converted clutches (CSTCC), stepped automatic transmissions or dual clutch transmissions (DCT).

The following examples provide illustrations of the invention. These examples are non-exhaustive and are not intended to limit the scope of the invention.

EXAMPLES

Preparative Example 1

Thiadiazole-Functionalized Dispersant (Prep1)

A flask is charged with about 3000 pbw (parts by weight) of polyisobutylene succinic anhydride prepared by an "ene-reaction. The polyisobutylene polymer from which the anhydride was made has a number average molecular weight of about 950 to about 1000. Then about 540 pbw of diluent oil and about 450 pbw polyamine is slowly added at about 110° C. The reaction is then heated to about 175° C. and held for about 5 hours, before cooling to ambient. The mixture is then filtered through diatomaceous earth to provide a viscous brown dispersant product. A four necked round bottom flask equipped with stirrer is charged with about 3200 pbw of the above dispersant product and about 2000 pbw mineral oil. The reaction mixture is heated to about 110° C. and about 640 pbw 2,5-dimercapto-[1,3,4]-thiadiazole is added to the reaction. The temperature is increased to about 135° C. and held for about 2 hours. The reaction is then heated to about 160° C. and about 640 pbw 2,5-dimercapto-[1,3,4]-thiadiazole is added to the reaction. The mixture is held for about 3 hours at about 160° C., before cooling to ambient. The product is filtered over diatomaceous earth. The final product is a viscous dark liquid.

Preparative Example 2

Thiadiazole-Functionalized Dispersant (Prep2)

The process is similar to Preparative Example 1, except the four necked round bottom flask equipped with stirrer is charged with about 2500 pbw of the dispersant product and about 416 g mineral oil and about 625 pbw 2,5-dimercapto-[1,3,4]-thiadiazole. The mixture is then held for about 7 hours at about 150° C., before cooling to ambient. The product is filtered over diatomaceous earth. The final product is a viscous dark liquid.

Preparative Example 3

Thiadiazole-Functionalized Dispersant (Prep3)

A vessel is charged with about 1000 pbw of a polyisobutylene succinic anhydride prepared from a polyisobutylene polymer with a number average molecular weight of about 950 to about 1000. In addition the polyisobutylene polymer is prepared from a chorine-mediated maleination process. The vessel is heated and about 110 pbw pentaerythritol is added, followed by heating to about 200° C. for 4 hours. The vessel is then charged with about 850 pbw mineral oil, before cooling to about 140° C. The mixture is then filtered through diatomaceous earth and and 1000 pbw of product is charged to a second reaction vessel of the filtered product. To this mixture about 65 pbw 2,5-dimercapto-[1,3,4]-thiadiazole and about 130 pbw diluent oil is added. The reaction is heated to about 150° C. and held for 4 hours and the resulting mixture filtered through diatomaceous earth to obtain a viscous brown liquid.

Lubricating Compositions Examples

A series of lubricating compositions are prepared as summarised in Tables 1 and 2. The amounts of each additive are presented in an amount that includes the presence of conventional amounts of diluent oil. For each example, the balance to 100 wt % comprises a polyalphaolefin base oil.

Each example (RF1, EX1 to EX10) is tested in a Baker Grade Simulation Axle Test as described in SAE 2005-01-3893. The test simulates a vehicle green axle break-in under high load conditions. The reported result is the peak temperature recorded in the axle during this procedure. Typically better performance is obtained for examples that have lower peak temperatures in the test. The results obtained are shown in Table 1 and 2. The temperatures recorded are rounded to the nearest degree Celsius or Fahrenheit.

Overall the results of the Baker Grade Simulation Axle Test indicate that the lubricating composition of the invention is capable of providing at least one of acceptable fuel economy, acceptable lowering of operating temperatures, acceptable viscosity and acceptable wear protection.

TABLE 1

| Lubricant Component | RF 1 | EX 1 | EX 2 | EX 3 | EX 4 |
|---|---|---|---|---|---|
| Viscosity Modifier | 23 | 33 | 33 | 33 | 33 |
| Prep 1 | 0 | 0.5 | 1.35 | 2.0 | 0.5 |
| Prep 3 | 0 | 0 | 0 | 0 | 0 |
| Phosphorus Antiwear | 1.66 | 1.73 | 1.73 | 1.73 | 1.73 |
| Polysulphide | 4.6 | 3.0 | 3.0 | 3.0 | 4.0 |
| Friction Modifier | 1.57 | 0 | 0 | 0 | 0 |
| Corrosion Inhibitor | 0.193 | 0.47 | 0.47 | 0.47 | 0.47 |
| Diluent Oil | 2.1 | 3.3 | 2.4 | 1.8 | 2.3 |
| Conventional Dispersant | 1.25 | 0.9 | 0.9 | 0.9 | 0.9 |
| Foam Inhibitor | 0.1 | 0.1 | 0.1 | 0.1 | 0.1 |
| Baker Grade Simulation Axle Test | | | | | |
| Peak Temperature (° F.) | 395 | 372 | 278 | 274 | 343 |
| Peak Temperature (° C.) | 202 | 189 | 137 | 134 | 173 |

TABLE 2

| Lubricant Component | EX 5 | EX 6 | EX 7 | EX 8 | EX 9 | EX 10 |
|---|---|---|---|---|---|---|
| Viscosity Modifier | 33.0 | 33.0 | 33.0 | 33.0 | 33.0 | 8.0 |
| Prep 1 | 1.35 | 2.0 | 1.0 | 0.75 | 0 | 5 |
| Prep 3 | 0 | 0 | 0 | 0 | 2.0 | 0 |
| Phosphorus Antiwear | 1.73 | 1.73 | 1.73 | 1.73 | 1.73 | 0.5 |
| Polysulphide | 4.0 | 4.0 | 4.0 | 4.0 | 4.0 | 4.0 |
| Friction Modifier | 0 | 0 | 0 | 0 | 0 | 0 |
| Corrosion Inhibitor | 0.47 | 0.47 | 0.47 | 0.47 | 0.47 | 0.55 |
| Diluent Oil | 1.4 | 0.8 | 1.8 | 2.0 | 0.8 | 1.1 |
| Conventional Dispersant | 0.9 | 0.9 | 0.9 | 0.9 | 0.9 | 0 |
| Foam Inhibitor | 0.1 | 0.1 | 0.1 | 0.1 | 0.1 | 0.07 |
| Baker Grade Simulation Axle Test | | | | | | |
| Peak Temperature (° F.) | 280 | 266 | 283 | 288 | 290 | Not Run |
| Peak Temperature (° C.) | 138 | 130 | 139 | 142 | 143 | Not Run |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lubricating an axle gear comprising supplying to the axle gear a lubricating composition comprising an oil of lubricating viscosity, a thiadiazole-functionalised dispersant and a polysulphide, wherein the polysulphide comprises at least 20 wt % of tri- or higher sulphides, and wherein the thiadiazole-functionalised dispersant is prepared by heating together ingredients comprising:

(i) a dispersant substrate;

(ii) a thiadiazole compound;

(iii) a dicarboxylic acid of an aromatic compound selected from the group consisting of 1,3 diacids and 1,4 diacids, (iv) optionally a borating agent; and (v) optionally a phosphorus acid compound, said heating being sufficient to provide a product of (i), (ii), (iii) and optionally (iv) and optionally (v), which is soluble in an oil of lubricating viscosity.

2. The method of claim 1, wherein the polysulphide comprises at least 30 wt % of tri- or higher sulphides.

3. The method of claim 1, wherein at least about 50 wt % of the polysulphide molecules comprise a mixture of tri- and tetrasulphides.

4. The method of claim 1, wherein the polysulphide contains less than about 30 wt % of a disulphide.

5. The method of claim 1, wherein the polysulphide provides about 0.5 to about 5 wt % of sulphur to the lubricating composition.

6. The method of claim 1, wherein the polysulphide is present at about 0.01 to about 10 wt % of the lubricating composition.

7. The method of claim 1, wherein the thiadiazole-functionalised dispersant is prepared by a method selected from the group consisting of heating, reacting and complexing a thiadiazole compound with a dispersant substrate.

8. The method of claim 7, wherein the dispersant substrate comprises a succinimide dispersant, a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant, a polyetheramine dispersant, a viscosity modifier containing dispersant functionality, or mixtures thereof.

9. The method of claim 8, wherein the dispersant substrate comprises a succinimide dispersant, an ester-containing dispersant or a Mannich dispersant.

10. The method of claim 8, wherein the dispersant substrate comprises a succinimide dispersant, and wherein about 0 mol % to less than about 50 mol % of the succinimide dispersant molecules contain a carbocyclic ring.

11. The method of claim 7, wherein the thiadiazole compound comprises a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadaizole.

12. The method of claim 7, wherein the weight ratio of dispersant substrate to the thiadiazole compound ranges from greater than about 0.1 to about 9.

13. The method of claim 1, wherein the thiadiazole-functionalised dispersant is present at about 0.1 wt % to about 8 wt % of the lubricating composition.

14. The method of claim 1, wherein the thiadiazole-functionalised dispersant is present at about 0.1 wt % to about 8 wt % of the lubricating composition; and wherein and the polysulphide is present at about 0.01 to about 10 wt % of the lubricating composition.

15. The method of claim 1 further comprising a phosphorus-containing acid, salt or ester antiwear agent comprising (i) a non-ionic phosphorus compound; (ii) an amine salt of a phosphorus compound; (iii) an ammonium salt of a phosphorus compound; (iv) a monovalent metal salt of a phosphorus compound; or (v) mixtures of (i), (ii), (iii) or (iv); and wherein the phosphorus-containing acid, salt or ester antiwear agent is present at about 0.05 wt % to about 10 wt % of the lubricating composition.

16. The method of claim 1, wherein the oil of lubricating viscosity comprises at least one of an API Group II, III, IV base oil, or mixtures thereof.

17. The methods of claim 1, wherein the dicarboxylic acid of an aromatic compound comprises terephthalic acid.

18. A method of lubricating an axle gear comprising supplying to the axle gear a lubricating composition comprising an oil of lubricating viscosity and a thiadiazole-functionalised dispersant, wherein the dispersant comprises either (i) an ester dispersant or (ii) a succinimide dispersant, wherein about 0 mol % to less than about 50 mol % of the succinimide dispersant molecules contain a carbocyclic ring, and wherein the thiadiazole-functionalised dispersant is prepared by heating together ingredients comprising:

(i) a dispersant substrate;

(ii) a thiadiazole compound;

(iii) a dicarboxylic acid of an aromatic compound selected from the group consisting of 1,3 diacids and 1,4 diacids, (iv) optionally a borating agent; and (v) optionally a phosphorus acid compound, said heating being sufficient to provide a product of (i), (ii), (iii) and optionally (iv) and optionally (v), which is soluble in an oil of lubricating viscosity.

* * * * *